US006159111A

United States Patent [19]

Purcell

[11] Patent Number: 6,159,111

[45] Date of Patent: Dec. 12, 2000

[54] BASKETBALL SHOOTING GUIDE AND DEFENSIVE PARTNER

[76] Inventor: Boyd C. Purcell, 600 Westmoreland Dr., Dunbar, W. Va. 25064

[21] Appl. No.: 09/312,112

[22] Filed: May 14, 1999

[51] Int. Cl.[7] ..... A63B 69/00; A63B 69/22

[52] U.S. Cl. ..... 473/422; 473/447; 473/472; 482/87; 248/127

[58] Field of Search ..... 482/87, 148; 248/165, 248/127, 159; 273/440, 449; 473/417, 422

[56] References Cited

U.S. PATENT DOCUMENTS

| | | | |
|---|---|---|---|
| D. 56,084 | 8/1920 | Thomsen | D6/457 |
| 602,517 | 4/1898 | McFadden | 482/87 |
| 1,661,805 | 3/1928 | Lentaty | 248/127 |
| 3,313,505 | 4/1967 | Petrie | 248/165 |
| 4,319,748 | 3/1982 | Alter | 482/148 |

*Primary Examiner*—Mark S. Graham
*Assistant Examiner*—Mitra Aryanpour

[57] ABSTRACT

A portable basketball training device used to teach basketball players how to properly shoot. The training device is comprised of a folding base and a telescoping vertical column supported by the base; attached to the top of the vertical column is a horizontally adjustable u-shaped shooting guide. The training device is used by first unfolding the legs and then adjusting the telescoping vertical column to the appropriate height, which is determined by adjusting the telescoping vertical posts until the bottom of the u-shaped shooting guide is parallel to the wrist of the user's shooting arm with the elbow extended to the shooting position. Once the appropriate height has been set the u-shaped shooting guide is adjusted horizontally in order to prevent horizontal drift of the shooting hand as the ball is projected toward the goal. Proper use of this device also provides optimal arc and natural backspin giving the ball truer flight to the goal. The basketball shooting guide and defensive partner is a unique combination training device where the user, through shooting repetition, develops muscle memory in the shooting hand and arm, acquires managed control over vertical elevation and horizontal drift of the projected basketball resulting in more consistent accuracy and improved shooting over a defender.

1 Claim, 3 Drawing Sheets

BASKETBALL SHOOTING GUIDE AND DEFENSIVE PARTNER

BACKGROUND

1. Field of Invention

This invention relates to basketball shot training aids, specifically, to an improved means for basketball players to develop proper shooting skills and enable experienced players, who are "out of sync" to regain proper shooting form.

2. Description of Prior Art

In the prior art, means of basketball shot training aids require that the users stand within a rectangular frame mounted on an adjustable vertical stand or attach a mechanical device to the athlete's body. Several inventors have invented basketball training aids that assist players in developing a proper shooting technique.

U.S. Pat. No. 4,538,808 (1985) issued to Holland discloses a device where the user stands inside a cage of tubular framework and shoots while attempting to dodge pairs of simulated defensive arms. Although this device provides the user with somewhat of a defensive partner the user is not challenged when making a jump shot nor is there any control over horizontal drift.

U.S. Pat. No. 5,599,016 (1997) issued to Larkin discloses a muscle memory basketball training aid and method that includes a rectangular frame mounted to a longitudinal adjustable base in which the user is positioned under the opening in the frame and projects a basketball through the opening. Through repetition muscle-memory in the shooter's arm is achieved. The user here, through shooting repetition, achieves muscle-memory; however, there is no control over horizontal drift and no defensive challenge is made to the user. Also, this device can not be easily transported from one facility to another.

U.S. Pat. No. 5,485,993 (1996) issued to Lipsett describes a moveable basketball training device that includes elongated arms that simulate the outstretched arms of a basketball defender. This device presents the user with a simulated defensive player's outstretched arms but it does not provide for any control of horizontal drift or muscle-memory.

U.S. Pat. No. 5,324,026 (1994) issued to Conlon and Stochmal describes a basketball training device that includes a somewhat bulky and cumbersome upright housing stand with an attached swing arm mechanism and an elbow harness which is attached to the arm of the user.

OBJECTS AND ADVANTAGES

Several objects and advantages of the present invention are:

(a) to provide a basketball training device which utilizes muscle-memory using a vertical height adjustment for proper elevation and horizontal adjustment to control horizontal drift primarily for foul shooting, but also for 3-point (non-jump) shooting and jump shooting which also provides optimal arc and natural backspin giving the ball truer flight to the goal;

(b) to provide a basketball shot training device that is of new and novel design, of simple and economic manufacture and one otherwise well suited to the uses and purposes for which it is intended;

(c) to provide a basketball shot training device which is easy to use, easily assembled and disassembled and compact to easily be transportable and storable;

(d) to provide a basketball shot training device which simulates a defensive partner in that the horizontal base of the u-shaped shooting guide can be used to shoot over thus simulating the out-stretched hand of a defensive player.

DRAWING FIGURES

In the drawings, closely related figures have the same number but different alphabetic suffixes.

Reference Numerals in Drawing

| | | | |
|---|---|---|---|
| 7 | short piece of tubing | 8 | brackets |
| 9 | legs | 10 | projection with threaded hole |
| 11 | thumbscrew | 12 | vertical post |
| 13 | short piece of tubing (closed-end) | 14 | brackets |
| 15 | limiting legs | 16 | vertical post |
| 17 | thumbscrew | 18 | projection with threaded hole |
| 19 | vertical post | 20 | thumbscrew |
| 21 | projection with threaded hole | 22 | short piece of tubing |
| 23 | thumbscrew | 24 | projection with threaded hole |
| 25 | u-shaped shooting guide | 26a | thumbscrew |
| 26b | thumbscrew | 27a | projection with threaded hole |
| 27b | projection with threaded hole | | |

DESCRIPTION—DRAWING

Figure 1:
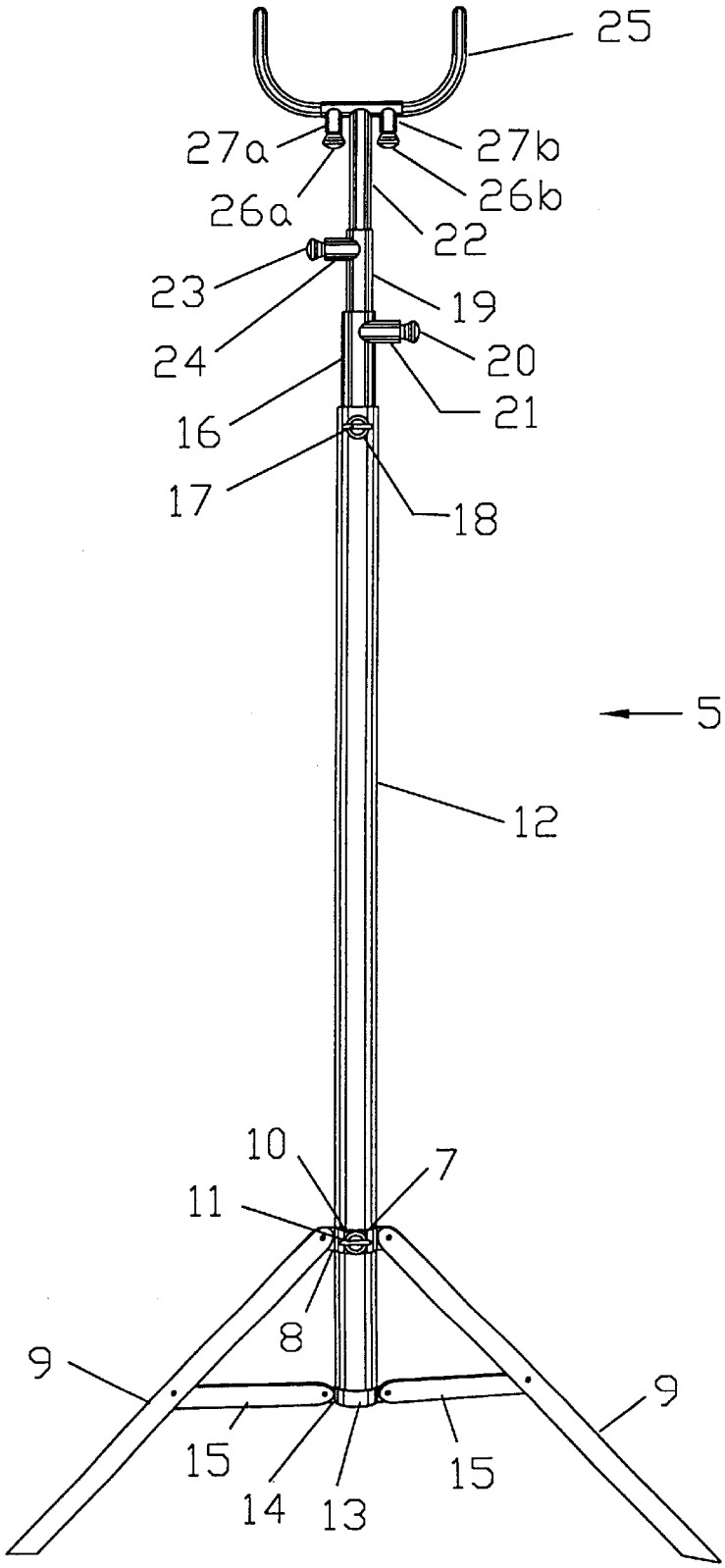
FIG. 1 shows a perspective view of the present invention.

Referring more specifically to the drawings, the basketball shooting guide and defensive partner is generally designated 5 in FIG. 1. The foldable leg mechanism has a short piece of tubing 7 vertically oriented. The internal diameter of tubing 7 is such that the vertical post 12 fits through tubing 7 with a slidable fit. Three brackets 8 are welded to the exterior of vertically oriented tubing 7 spaced 120 degrees apart. A leg 9 is rotatably attached to each bracket 8.

Between two of the brackets 8 is a projection 10 having a threaded hole. A thumb screw 11 is inserted into the threaded portion of projection 10. When the folding leg structure is completely unfolded; thumbscrew 11 is tightened against vertical post 12, which keeps the folding base in position. A short piece of tubing 13, closed at the bottom, is vertically oriented below tubing 7. Tubing 13 has the same internal diameter as tubing 7. The welded brackets 14 are spaced 120 degrees apart, and are located directly below brackets 8. Three limiting legs 15 are rotatably attached to brackets 14 at one end. The second end of each limiting leg 14 is rotatably attached to the middle of leg 9. The limiting legs 15 prevent legs 9 from spreading too far, and insure that there is a vertical distance between tubing 7 and tubing 13 for proper support of vertical post 12.

Vertical post 12 which is hollow extends upward for approximately 33 inches. At that point vertical post 16, which is hollow, is inserted therein and extends upward approximately 33 inches. Vertical post 16 has a slidable fit within post 12 which can be adjusted vertically up or down. Once the desired height adjustment has been made a thumbscrew 17 is inserted into the threaded hole of projection 18 and tightened against vertical post 12 which keeps vertical post 16 in position.

At that point vertical post 19, which is hollow, is inserted therein and extends upward approximately 33 inches. Vertical post 19 has a slidable fit within post 16 which can be adjusted vertically up or down. Once the desired height adjustment has been made a thumbscrew 20 is inserted into the threaded hole of projection 21 and tightened against vertical post 16 which keeps vertical post 19 in position. The upper end of vertical post 19 carries a horizontally adjustable u-shaped shooting guide 25.

The u-shaped shooting guide 25 is attached to the top of vertical post 19 by means of a downward facing short piece of tubing 22 having a diameter which permits a slidable fit of the u-shaped shooting guide 25 within vertical post 19. Thumbscrew 23 extends through the threaded hole of projection 24 and tightened against vertical post 19 which keeps the u-shaped shooting guide in position.

Figure 2:
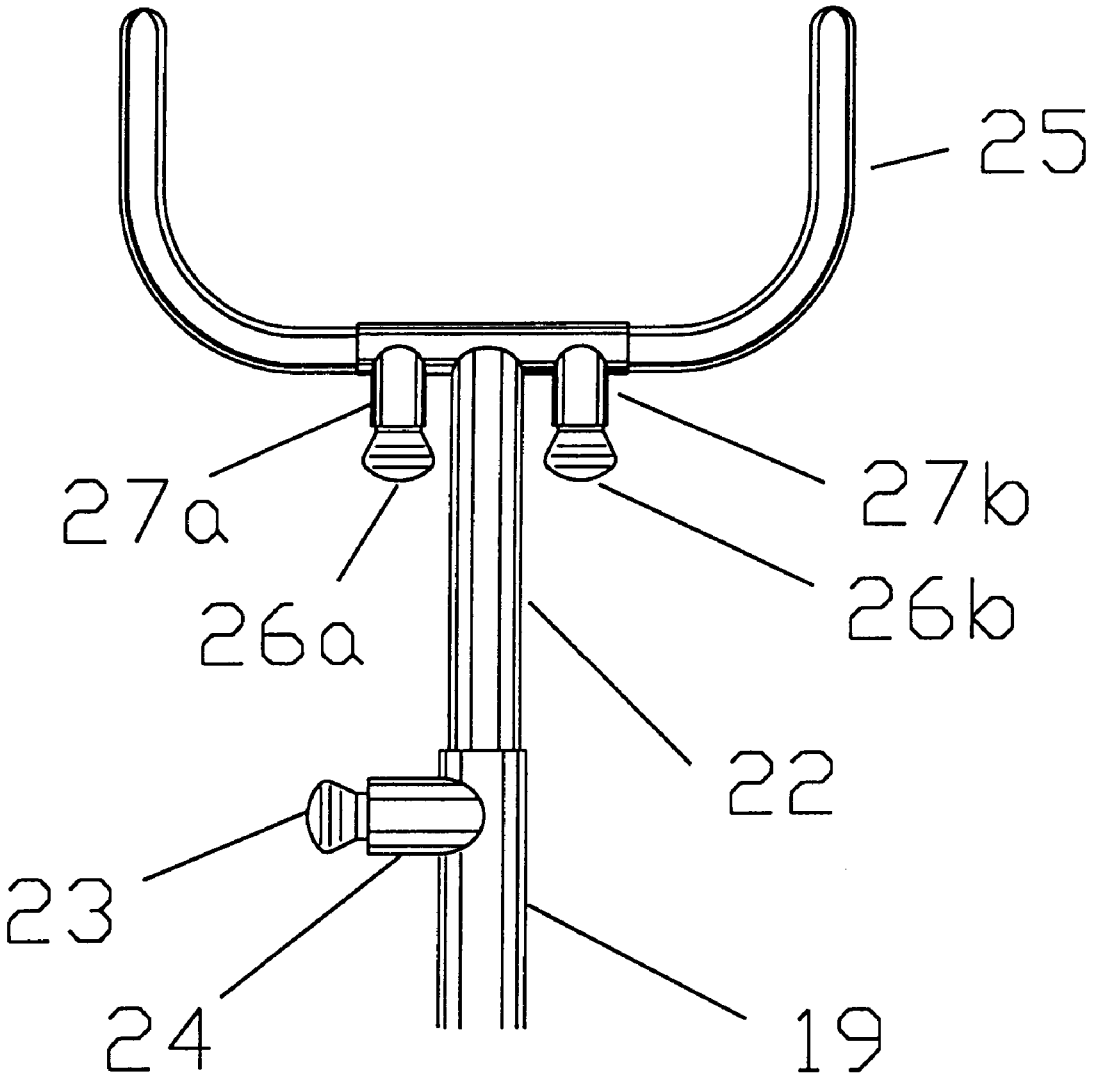
FIG. 2 shows an enlarged isometric view of the u-shaped shooting guide.
Figure 3:
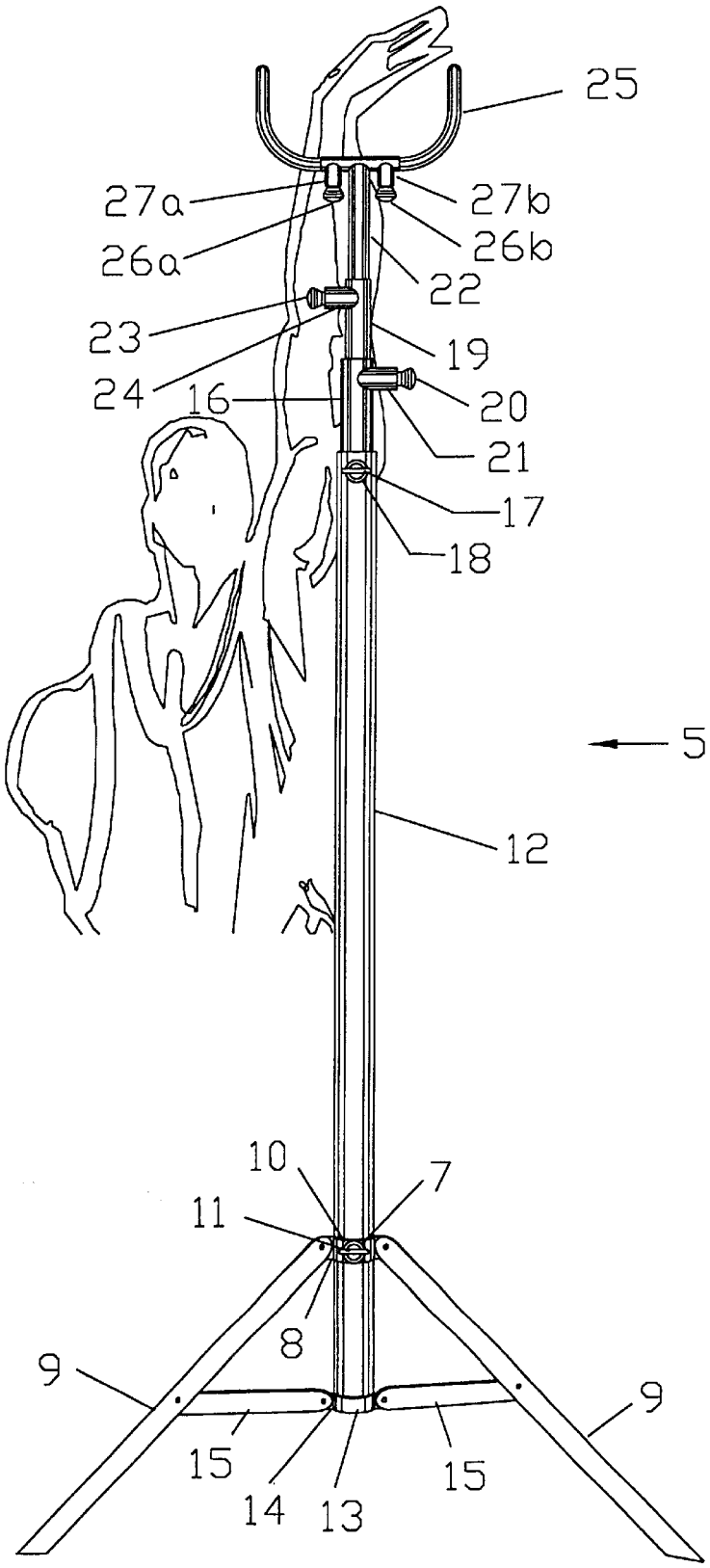
FIG. 3 shows a perspective view of the basketball shooting guide and defensive partner of FIG. 1 in use with the user's shooting hand between the vertical posts of the shooting guide, wrist parallel to the horizontal bar with shooting arm and elbow extended.

The u-shaped shooting guide as illustrated in FIG. 2 is adjustable horizontally left or right. Once the desired horizontal distance has been made thumbscrews 26*a* and 26*b* are inserted into the threaded holes of projections 27*a* and 27*b* and tightened. From the description above, a number of advantages of my basketball shooting guide and defensive player become evident:

(a) It is a compact device of simple design.

(b) Assembly and disassembly are easy and simple. Each member of a basketball team can have one's own device and easily transport it to various practice sites. Its compactness requires very little storage space.

(c) The training device is an effective combination tool for controlling horizontal drift of the shooting hand and vertical height for proper elbow extension and shooting over a defensive player utilizing muscle memory.

Operation

The manner of using the basketball shooting guide and defensive partner is different from devices in present use in that my invention utilizes a horizontally adjustable u-shaped shooting guide 25 as a control for horizontal drift of the shooting hand in addition to the vertical height adjustment for proper elevation especially for foul shooting and 3-point shooting (non-jumping). A height adjustment commensurate with the peak of the user's vertical leap teaches the proper form for jump shooting. By repetitive use the user acquires a more consistent control over the accuracy of the shooting path of the basketball as it is projected through the vertical uprights of the u-shaped shooting guide 25. In addition, utilizing the shooting guide simulating a defensive player the user is constantly challenged defensively and learns to shoot over the simulated blocking hand of a defender. Repetitive use of the basketball shooting guide and defensive partner provides the user with a unique combination training tool for controlling vertical elevation, horizontal drift, shooting over a defender utilizing muscle memory.

Summary, Ramifications and Scope

Accordingly, the reader will see that the basketball shooting guide and defensive partner of this invention can be effectively used in developing a basketball player's shooting technique for accuracy. This device is especially effective in teaching proper form for foul shooting but also works well for 3-point (non-jumping) shooting and jump shooting.

It is unique in that it provides the user a combination training tool that is light-weight, easily assembled and fits neatly into most gym bags to conveniently transport it from site to site. It also requires very little storage space. The simple design makes it easy to manufacture and affordable for individual players as well as schools, colleges and recreational centers.

Although the description above contains many specifications, these should not be construed as limiting the scope of this invention but merely providing illustrations of some of the presently preferred embodiments of this invention. For example, the thumbscrews can be replaced by a spring operated push and release locking device; the folding legs can be replaced by a weighted base, etc. Thus the scope of the invention should be determined by the appended claims and their legal equivalents, rather than by the examples given.

I claim:

1. A portable basketball shot training device for foul shooting, three-point shooting, non-jump shooting and jump shooting comprising: a three-part telescoping vertical column having upper, middle and lower posts supported by a folding base; an open U-shaped basketball shooting guide having a horizontal base member and two parallel depending arms atop the three-part vertical column, said U-shaped shooting guide being attached to said upper vertical post by means of a downward facing short piece of tubing having a diameter which permits a slidable fit of said shooting guide within said upper vertical post, said horizontal base member received in a horizontal tube permitting rotation of said base member about its longitudinal axis in the horizontal plane, said base member lockable relative to said horizontal tube in any desired position, said U-shaped shooting guide adapted to receive a user's hand therethrough.

* * * * *